US006129654A

United States Patent [19]

Mosburger et al.

[11] Patent Number: 6,129,654

[45] Date of Patent: Oct. 10, 2000

[54] HEATING DEVICE FOR A CORRUGATED CARDBOARD FACILITY

[75] Inventors: Hans Mosburger, Weiherhammer/Opf.; Thomas Hecky, Weiden; Hermann Josef Mensing, Weiherhammer, all of Germany

[73] Assignee: BHS Corrugated Machinen und Anlangenbau GmbH, Weiherhammer, Germany

[21] Appl. No.: 09/266,274

[22] Filed: Mar. 11, 1999

[30] Foreign Application Priority Data

Mar. 12, 1998 [DE] Germany ..... 198 10 841

[51] Int. Cl.[7] ..... B05C 1/00; B31F 1/20

[52] U.S. Cl. ..... 493/332; 493/463; 156/210; 156/470; 100/154

[58] Field of Search ..... 493/332, 463; 156/210, 470, 543, 555, 583.3, 583.5, 583.91; 100/154, 311

[56] References Cited

U.S. PATENT DOCUMENTS

| | | | |
|---|---|---|---|
| 4,889,580 | 12/1989 | Seki et al. | 156/210 |
| 5,005,473 | 4/1991 | Ishibashi | 100/154 |
| 5,256,240 | 10/1993 | Shortt | 156/210 |
| 5,632,830 | 5/1997 | Marschke | 156/210 |
| 5,766,405 | 6/1998 | Herklotz et al. | 156/543 |
| 5,925,209 | 7/1999 | Mosburger | 156/210 |
| 5,944,252 | 8/1999 | Connelly et al. | 156/210 |
| 5,993,587 | 11/1999 | Seki et al. | 493/463 |

*Primary Examiner*—John Sipos
*Assistant Examiner*—Steven Jensen
*Attorney, Agent, or Firm*—Shaffer & Culbertson, LLP

[57] ABSTRACT

A heating device (1) for a corrugated cardboard facility includes several heating plates (3) arranged sequentially along a path in the advancing direction of a sheet of corrugated cardboard (2). Compression elements (4) are arranged above the heating plates (3) in position to act on the sheet of corrugated cardboard (2) as it advances along the path. An intake belt (e) is located in a starting area (a) of the heating plates (3) between at least a part of the sheet of corrugated cardboard (2) and at least one compression element (4.1, 4.2).

20 Claims, 1 Drawing Sheet

HEATING DEVICE FOR A CORRUGATED CARDBOARD FACILITY

BACKGROUND OF THE INVENTION

The invention pertains to a heating device for a corrugated cardboard facility and, more particularly, to such a heating device having several heating plates arranged sequentially in the advancing direction of the sheet of corrugated cardboard, and also having compression elements arranged above the heating plates for acting on the sheet of corrugated cardboard.

Such a device in a corrugated cardboard facility has the function of drying glue between superimposed sheets, for example, one-sided sheets of corrugated cardboard and finally the cover sheet.

To this end, known devices have heating plates that are heated, for example, with steam or thermal oil. By means of a continuous transport belt, the sheet is conveyed through the heating zone. Compression elements press the sheets of corrugated cardboard against the surface of the heating plates in order to achieve an appropriate contact of the sheets of corrugated cardboard with the surface of the heating plates, that is, a good transfer of heat to the glue line.

In the case of one known compression unit shown in U.S. Pat. No. 5,632,830, weighted rollers are also used, which are affixed by intervening levers to a bearing arranged transversely to the advancing direction of the sheet of corrugated cardboard.

Further state of the art is also a compressing unit in the form of a pressure plate consisting of several units extending along the sheet of corrugated cardboard as shown in Canadian Patent No. 2,197,921. Also known is the use of pressure hoods shown in European Patent Publication EP 0,412,255 A1, as well as rollers shown in U.S. Pat. No. 5,632,830, which exert pressure on a circulating conveyor belt.

In order to avoid the disadvantages of the transport belt, it is also state of the art, as shown in U.S. Pat. No. 5,632,830, that the transport belt is eliminated and the sheet of corrugated cardboard is pressed directly against the heating surfaces by compression elements.

When the transport belt is dispensed with, however, automatic intake of the introduced sheets is no longer possible. Furthermore, eliminating the transport belt results in increased friction with the cardboard, and this increased friction produces frequent tears in the cardboard as it passes through the heating zone. Tears in conjunction with troublesome reinsertion bring about unacceptable production losses.

SUMMARY OF THE INVENTION

Accordingly, the basic objective of the present invention is to create a corrugated cardboard heating device in which the sheets of corrugated cardboard arriving from preceding parts of the facility are drawn in and automatically advanced through the beltless part of the heating device.

This objective is realized according to the invention, in that an intake belt is located in the starting area of the heating plates between at least a part of the sheet of corrugated cardboard and at least one compression element. With the aid of this intake belt it is possible to join together functionally securely the individual layers of the corrugated cardboard and also to compensate for any possible frictional losses of the preceding facility sections.

The intake belt can be designed as a conveyor belt running over two physically separated deflection rollers. Here there exists the possibility that the conveyor belt is acted upon by at least one compression element oriented in the advancing direction of the sheet of corrugated cardboard. Furthermore, the intake belt can be designed to be heated.

For good adaptation to the given conditions, it is possible that the distance between the two deflection rollers be variable. Here the rear deflection roller can be designed to be displaceable in the running direction of the sheet of corrugated cardboard with the conveyor belt running over an adjustable tension roller.

According to one embodiment form of the invention, the possibility exists that all of the layers of the sheet of corrugated cardboard can be affected by the compression elements acting on the conveyer belt. Alternatively, it is also feasible, for example, with three layers of the sheet of corrugated cardboard, that the compression elements acting on the conveyor belt initially affect only two layers of the sheet of corrugated cardboard and that the third layer be added to the sheet of corrugated cardboard behind the second deflection roller. This third layer can, for example, be transported by a feeder roller.

In order to achieve a more rapid gluing, heatable compression elements can be provided in front of the feeder roller.

A particularly simple embodiment of the invention results when the heating device is designed with an upper and a lower intake roller in the initial area of the heating plates. In this case, the upper intake roller can also serve as the first deflection roller for the conveyor belt.

In a further refinement of the invention, the feeder roller can also be designed to be heatable.

These and other objects, advantages, and features of the invention will be apparent from the following description of the preferred embodiments, considered along with the accompanying drawings.

DESCRIPTION OF THE PREFERRED EMBODIMENTS

Figure 1:
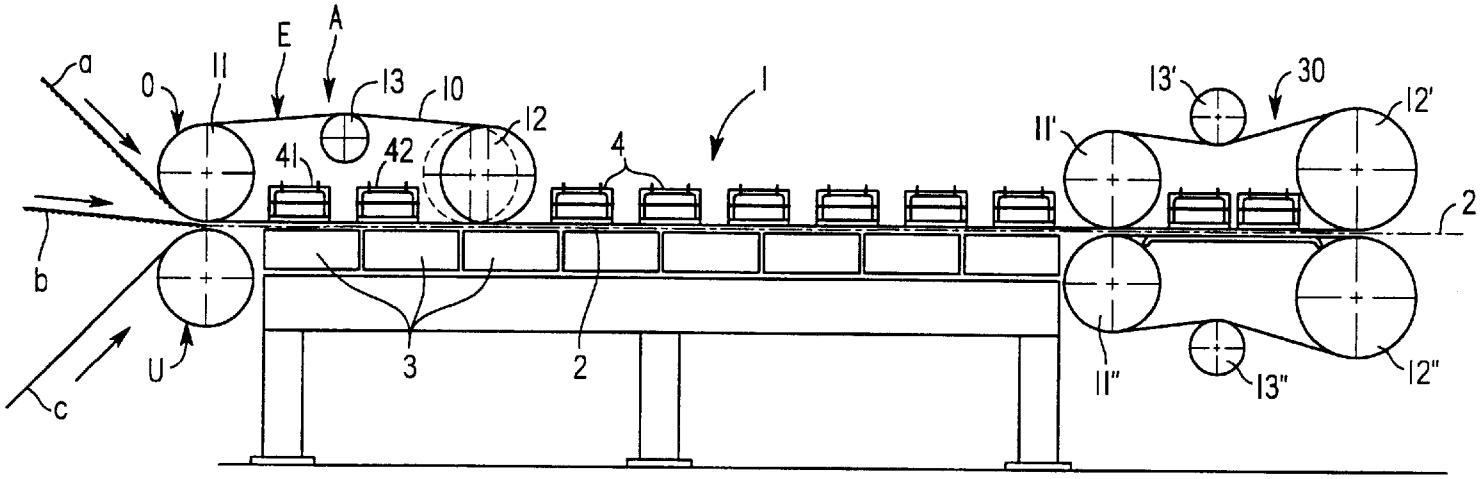
FIG. 1 is a schematic side view of a first embodiment of the invention.

Illustrated in FIG. 1 is a heating device 1 for a corrugated cardboard facility. Heating device 1 consists of several heating plates 3 arranged sequentially in the advancing direction of the sheet of corrugated cardboard 2 and arranged above them, compression elements 4 acting on the sheet of corrugated cardboard 2. The sheet of corrugated cardboard 2 can consist of several layers, for example, a one-sided sheet of corrugated cardboard "a", another one-sided sheet of corrugated cardboard "b" and a cover sheet "c".

The compression elements 4 can be of any desired design, for example, a pressure hood, weighted rollers, or pneumatically charged compression units.

The sheet of corrugated cardboard 2 runs from a starting area "A" of the heating plates 3 to a tractor station 30 in the end area, which undertakes the cooling of the glued sheet of corrugated cardboard 2 by way of conveyor bands, rollers 11' and 11" as well as 12' and 12", tension rollers 13' and 13" as well as compression elements 4, and furthermore serves to transport the sheet and to compensate for the high friction losses, especially in the case of a beltless heating section.

According to the invention, an intake belt "E" is positioned in the starting area "A" of the heating plates 3 between at least a part of the sheet of corrugated cardboard 2 and at least one compression element, in this case two such elements 4.1 and 4.2. This intake belt "E" can be designed as a conveyor belt 10 running over at least two physically separated deflection rollers 11 and 12. This conveyor belt 10 can be heated, for example, by way of deflection rollers 11 and 12.

In the embodiment of the invention shown in FIG. 1, the conveyor belt 10 is acted on by at least two compression elements, compression elements 4.1 and 4.2 arranged sequentially in the running direction of the sheet of corrugated cardboard.

As can be seen in FIG. 1, an upper intake roller "O" and a lower intake roller "U" are present in the starting area "A". Here it is possible that the upper intake roller "O" also forms the first deflection roller "11" for the conveyor belt "10".

As indicated in broken outline in FIG. 1, it is possible to vary the distance between the two deflection rollers 11 and 12, for example, in that the rear deflection roller 12 is designed to be displaceable in the running direction of the sheet of corrugated cardboard 2. Here adjustable tension roller 13 is especially advantageous, whereby assurance is given that when the separation of the two deflection rollers is changed, the conveyor belt 10 always remains tautly tensioned.

In the embodiment of the invention according to FIG. 1, all three layers ("a", "b" and "c") of the sheet of corrugated cardboard 2 are acted upon by the conveyor belt 10 and the two compression elements 4.1 and 4.2 in the starting area A.

Figure 2:
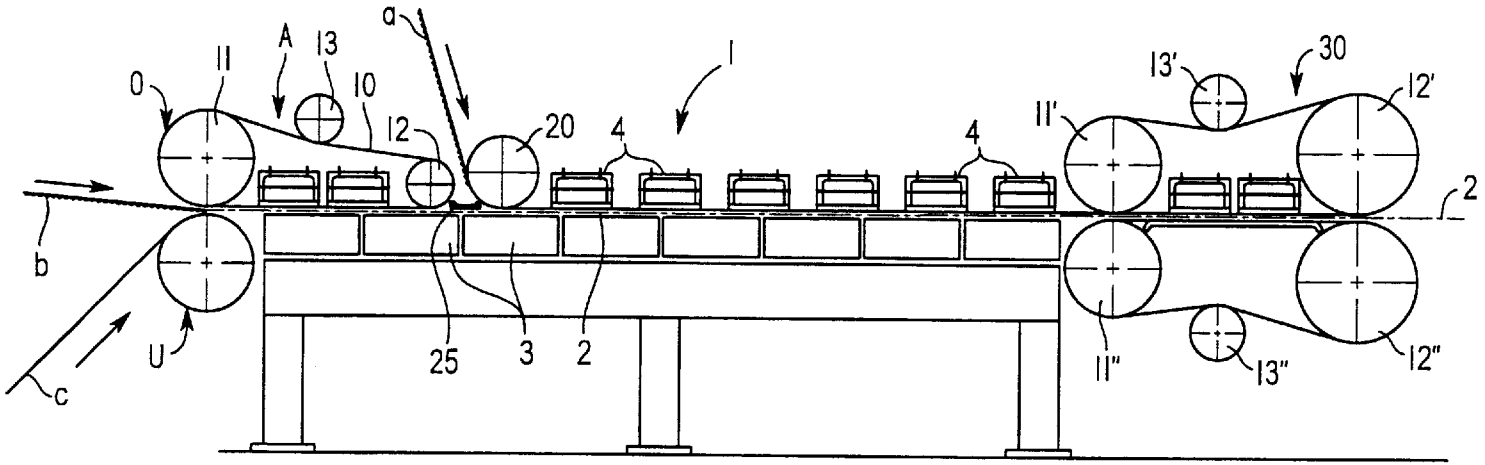
FIG. 2 is a schematic side view of an alternative embodiment of the invention.

According to FIG. 2, it is also possible that only two layers, namely "b" and "c", are acted upon by the conveyor belt "10", which itself again runs over two deflection rollers 11 and 12. The third layer "a" is introduced via a feeder roller 20 behind the second deflection roller 12. Accordingly, a complete sheet of corrugated cardboard 2 is formed, which is in turn acted upon by the aforesaid compression elements 4, and runs over the surface of the heating plates 3. At least one heatable compression element 25 can be provided between the deflection roller 12 and the feeder roller 20.

By virtue of the present invention, assurance is given in a simple manner that the layers ("a", "b" and "c") to be glued are so joined together that an adequately stiff sheet of corrugated cardboard 2 is formed, which can be automatically threaded into the corresponding heating section with the heating plates 3.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. In a heating device for a corrugated cardboard facility, where the heating device includes a plurality of heating plates arranged along a path for a sheet of corrugated cardboard, and where the heating device also includes compression elements arranged above the heating plates for acting on the sheet of corrugated cardboard as it advances along the path, the improvement comprising:

(a) an intake belt located in a starting area of the heating plates, a portion of the intake belt being interposed between a part of the path for the sheet of corrugated cardboard and at least one of the compression elements, with at least one of the heating plates and at least one of the compression elements located along a portion of the path for the sheet of corrugated cardboard beyond the intake belt in position to act directly on the sheet of corrugated cardboard as the sheet moves along the path.

2. The device according to claim 1 wherein the intake belt comprises a conveyor belt running over at least two spaced apart deflection rollers.

3. The device according to claim 2 wherein the conveyor belt is acted on by at least one of the compression elements.

4. The device according to claim 1, further comprising an arrangement for heating the intake belt.

5. The device according to claim 2, further comprising an arrangement for varying the distance between the deflection rollers.

6. The device according to claim 5:

(a) wherein the plurality of deflection rollers includes a rear deflection roller and wherein the arrangement for varying the distance between the deflection rollers includes an arrangement for displacing the rear deflection roller in a running direction of the path for the sheet of corrugated cardboard; and (b) further comprising an adjustable tension roller for tensioning the conveyor belt.

7. The device according to claim 1 wherein the sheet of corrugated cardboard includes at least three layers of material and the compression elements are adapted to compress all of the layers of the sheet of corrugated cardboard against the intake belt.

8. The device according to claim 2:

(a) wherein the sheet of corrugated cardboard includes at least three layers of material and the compression elements are adapted to compress less than all of the layers of the sheet of corrugated cardboard against the intake belt; and (b) further comprising an arrangement for introducing at least one layer of the sheet of corrugated cardboard at a point behind a rear deflection roller along the path for the sheet of corrugated cardboard.

9. The device according to claim 8 wherein the arrangement for introducing at least one layer comprises a feeder roller.

10. The device according to claim 9, further comprising a heating arrangement for heating the feeder roller.

11. The device according to claim 2, further comprising:

(a) an upper intake roller and a lower intake roller positioned in the starting area of the heating plates, the upper intake roller comprising a first deflection roller for the conveyor belt.

12. The device according to claim 9 wherein at least one compression element is located between a first deflection roller and the feeder roller.

13. A heating device for a corrugated cardboard facility, the heating device comprising:

(a) a first heating plate arranged along a path for a sheet of corrugated cardboard;

(b) a first compression element arranged along the path for the sheet of corrugated cardboard and spaced apart from the first heating plate wherein the first heating plate and the first compression element are in position to act directly on the sheet of corrugated cardboard as the sheet advances along the path; and (c) an intake belt located in a starting area of the heating device along the path for the sheet of corrugated cardboard and adapted to travel in a direction in which the sheet of corrugated cardboard advances along the path, the intake belt being located along the path in a spaced apart position and upstream with respect to the first heating plate and the first compression element.

14. The device according to claim 13 wherein a portion of the intake belt along the path of the sheet of corrugated cardboard material is interposed between an additional heating plate and an additional compression element.

15. The device according to claim 13 further comprising a tractor arrangement at an outlet end of the heating device, the tractor arrangement contacting the sheet of corrugated cardboard and urging the sheet along the path.

16. The device according to claim 13 wherein the intake belt comprises a conveyor belt running over at least two spaced apart deflection rollers.

17. The device according to claim 16 further comprising an arrangement for varying the distance between the deflection rollers.

18. The device according to claim 16 further comprising:

(a) an arrangement for introducing at least one layer of the sheet of corrugated cardboard at a point behind a rear deflection roller along the path for the sheet of corrugated cardboard.

19. The device according to claim 16 further comprising:

(a) an upper intake roller and a lower intake roller positioned in the starting area of the heating device, the upper intake roller comprising a first deflection roller for the conveyor belt.

20. The device according to claim 17:

(a) wherein the deflection rollers include a rear deflection roller and wherein the arrangement for varying the distance between the deflection rollers includes an arrangement for displacing the rear deflection roller in a running direction of the path for the sheet of corrugated cardboard; and (b) further comprising an adjustable tension roller for tensioning the conveyor belt.

* * * * *